US007232352B2

(12) United States Patent
Splaine

(10) Patent No.: US 7,232,352 B2
(45) Date of Patent: Jun. 19, 2007

(54) PADDLE HAND GRIPS AND METHOD FOR MAKING AND USING SAME

(76) Inventor: Deborah Kutny Splaine, 228 Asharoken Ave., Northport, NY (US) 11768

( * ) Notice: Subject to any disclaimer, the term of this patent is extended or adjusted under 35 U.S.C. 154(b) by 0 days.

(21) Appl. No.: 11/220,003

(22) Filed: Sep. 6, 2005

(65) Prior Publication Data

US 2006/0003645 A1 Jan. 5, 2006

Related U.S. Application Data

(63) Continuation-in-part of application No. 10/658,853, filed on Sep. 10, 2003, now abandoned.

(60) Provisional application No. 60/409,678, filed on Sep. 10, 2002, provisional application No. 60/421,621, filed on Oct. 28, 2002.

(51) Int. Cl.
*B63H 16/04* (2006.01)

(52) U.S. Cl. ..... 440/101

(58) Field of Classification Search ..... 440/101; 473/568; 16/110.1, 421; 441/101
See application file for complete search history.

(56) References Cited

U.S. PATENT DOCUMENTS

| | | | | |
|---|---|---|---|---|
| 2,984,486 | A * | 5/1961 | Jones | 473/568 |
| 5,042,804 | A * | 8/1991 | Uke et al. | 473/538 |
| 5,348,360 | A * | 9/1994 | Mencarelli et al. | 294/57 |
| 5,820,424 | A * | 10/1998 | Steinhour et al. | 440/101 |
| 6,022,278 | A * | 2/2000 | Vela | 473/201 |
| 6,328,617 | B1 * | 12/2001 | Gunnell | 440/101 |
| 2004/0050205 | A1 * | 3/2004 | Putnam | 74/558 |

* cited by examiner

*Primary Examiner*—Jesús D. Sotelo
(74) *Attorney, Agent, or Firm*—David Aker

(57) ABSTRACT

A comfort hand grip for a shaft comprises a tubular member formed of a closed cell resilient polymer material core; and a water resistant coating on each side of the core. The comfort grip is sized so as to be slightly stretched when positioned on a shaft, and includes an indexing mark for proper orientation of the paddle. The resilient polymer core may be formed of a rubber, and the coating of an ultraviolet resistant flexible material such as nylon. The hand grip may be formed from a die cut generally rectangular piece of material which is formed into the tubular structure by at least one of, for example, stitching which joins the opposite sides to one another; a lace through openings in joining portions of the material along the sides; a zipper having a side along each of the joining portions; and a set of hook and loop closures on opposite ones of the joining portions.

20 Claims, 7 Drawing Sheets

PADDLE HAND GRIPS AND METHOD FOR MAKING AND USING SAME

This application is a continuation-in-part of application Ser. No. 10/658,853 filed on Sep. 10, 2003 now abandoned, which claims priority under 35 U.S.C. §119(e) from provisional patent application Ser. No. 60/409,678 filed on Sep. 10, 2002 and provisional patent application Ser. No. 60/421,621, filed on Oct. 28, 2002, all of which are incorporated herein by reference, in their entirety.

BACKGROUND OF THE INVENTION

1. Field of the Invention

The present invention relates to articles for making gripping of a shaft more comfortable. In particular, it relates to hand grips that serve to make the use of a shaft, such as that of an oar or paddle more comfortable and efficient and assists people with hand and wrist disabilities in paddling. More particularly, it relates to hand or comfort grips which may be applied to the shaft of an oar or paddle and improve the performance of a user's existing paddle (without having to purchase a new or more expensive custom paddle) used with kayaks, canoes and human powered watercraft.

2. Prior Art

An oar or paddle for use with kayak, canoe and human powered watercraft, is compromised of an elongate shaft having a first end and a second end, at least one end of the shaft having a blade attached thereto.

The conventional method of paddling a kayak watercraft is to hold the paddle with both hands grasping the shaft of the paddle somewhere parallel to the paddler's or rower's shoulders, and dip the paddle in and out of the water to one side and then to the other. This motion causes significant friction between the shaft and hands during the paddling motion which causes blistering and calluses on the first web space and skin on the inside palms of the hands. Furthermore, this grasp on the paddle contributes to contusions (bruising) to the underlying metacarpal bones of the hand and phalanx bones of the fingers. Significant strain to the corresponding carpal tunnel area and tendons of the wrist are incurred with the force needed to firmly grasp and hold the smooth hard shaft of the paddle.

Efficiency of the paddling motion is reduced since a portion of the energy applied to the stroke of the paddling motion is lost in the slipping of the grasp.

People with disabilities of the hand and wrist (for example carpal tunnel syndrome, tendon injuries and arthritis) would be unable or too uncomfortable to hold a tight grip on the smooth hard shaft of the paddle.

Indexing is defined herein as feeling the proper position of a paddler's hands on the paddle. When aligned, the knuckles of the hand follow the edge of the paddle blade. Technique used in an Eskimo roll performed while seated in the kayak and for feathering strokes used during upright paddling (where feathering refers to holding the paddle so as to reduce wind resistance of the blade as it moves forward through the air and so that when the blade returns to the water, it is at right angles to the direction in which it will move through the water). While paddle shafts having oval cross-sections provide a degree of indexing, such indexing has not been available on paddles having circular shafts. Without having an index for the tips of the fingers, proper technique cannot be accomplished.

Keeping the paddler's hands from sliding to the left or right during paddling is especially difficult when the paddle is wet. Determining the correct hand positions on the paddle and maintaining the same, is critically important.

SUMMARY OF THE INVENTION

The present invention overcomes at least in part some of the aforementioned disadvantages.

It is an object of the invention to provide a hand grip that enables a user to comfortably grip a shaft and to prevent blisters on the hands.

It is a further object of the invention to provide a handgrip that is easily installed on a shaft.

It is a further object of the invention to provide indexing on any paddle for either right or left handed people on any round paddle shaft, and to provide proper hand placement for each individual by permitting custom adjustment on the paddle shaft.

It is a further object of the invention to provide the ability for the technique of feathering on any paddle.

It is a further object of the invention to insure proper hand placement without the hands slipping on the paddle shaft.

It is another object of the invention to provide a method for making such a hand grip.

It is still another object of the invention to provide a method for installing such a hand grip onto a shaft.

In accordance with the first aspect of the present invention there is provided two separate and independent comfort hand grips for use with a kayak, canoe or similar watercraft paddle. The comfort hand grip may be attached by the (user) (paddler) in the case of "take apart" types of paddles by sliding one comfort hand grip over each side of the paddle shaft into a position applicable to the (user) (paddler). With paddles that do not separate in the middle, each comfort grip may be supplied with a lengthwise cut or slit (to allow fitting over the elongate shaft), die cut vertical holes on each side of the comfort grips, and a lace to be used to secure the two ends together in a pattern similar to lacing shoes.

Furthermore, these comfort grips are manufactured with die cut closed cell rubber material in a predetermined thickness. This material will not absorb water to add weight to the grip which would be detrimental to the intended use. Additionally, the closed cell rubber material may be fused on one side with nylon material to add UV (ultraviolet) protection and extended useful life, and may be manufactured with an ingrained texture on the opposite side to add gripping ability, decrease slippage of grip and increase paddling efficiency, provide a soft feel, ease of installation on the paddle and a desired color (including colors for water safety), for the end user.

In accordance with the invention a comfort grip for a shaft comprises a tubular member formed of a closed cell resilient polymer material core, the tubular member having a longitudinally extending indexing mark along an external surface of the tubular member, the indexing mark being configured to be sensed when the shaft is gripped to allow proper orientation of the shaft by a user; and a water resistant coating on a first side of the core. A textured layer or surface may be provided on a second side of said core. The comfort is sized so as to be slightly stretched when positioned on a shaft. The resilient polymer core is formed of a rubber. The coating is formed of an ultraviolet resistant flexible material, such as a nylon.

The comfort grip may be initially in the form of a rectangular piece of material, comprising joining portions along two opposite sides of the rectangular piece, the joining portions being connected to form the tubular member.

Connecting means for connecting the joining portions may comprise at least one of stitching along edges of the sides to connect the joining portions; a lace disposed in the in the joining portions; a zipper having a side along each of the joining portions: and a set of hooks and loop closures on opposite ones of the joining portions. Other connecting or fastening means such as adhesives, staples, or other fasteners may also be used.

The comfort grip may further comprise end bands at ends of the tubular members. The end bands preferable comprise a stretchable material folded so as to have a first portion along an inner periphery of the tubular member and a second portion along an outer periphery of the tubular member.

The comfort grip is used, preferably, in combination with a shaft, the shaft being that of an oar or paddle that is configured for use in rowing. A second comfort grip may be placed on the shaft, with the comfort grips being positioned on the shaft so that each hand of a user may grip one of the comfort grips during rowing.

Also in accordance with the invention, a method for forming a comfort grip for a shaft, comprises providing a rectangular piece of stretchable material; and connecting two opposite sides of the rectangular piece of material to from a tubular member, the tubular member being sized so as to stretch around the shaft when a portion of the shaft is disposed within the tubular member. An indexing mark has an orientation at a rotational position that can be adjusted to each individual to align the knuckles of the hand with respect to a blade of the paddle.

The connecting is done by providing at least one of stitching which joins the opposite sides to one another; a lace through openings in portions of the material along the sides; a zipper having a side along each of the joining portions; and a set of hook and loop closures on opposite ones of the joining portions.

The method may further comprise providing end bands formed of a stretchable material along ends of the tubular member.

Providing the end bands may comprise positioning the bands with a first portion along an inner periphery of the tubular member and a second portion along an outer periphery of the tubular member; and fastening the end bands in place. The end bands may be positioned by sewing the end bands to the tubular member.

The invention is also directed to a method for placing a comfort grip on a shaft comprising providing a comfort grip including a tubular member formed of a closed cell resilient polymer material core, and a water resistant coating on each side of the core; and placing the comfort grip on the shaft by at least one of sliding the comfort grip onto the shaft; lacing the comfort grip to the shaft with a lace extending through opening in the tubular member; closing a zipper, the zipper having a side along each of the joining portions; and closing a set of hook and loop closures on opposite ones of the joining portions.

BRIEF DESCRIPTION OF THE DRAWINGS

The foregoing aspects and other features of the present invention are explained in the following description, taken in connection with the accompanying drawings, wherein like numerals indicate like elements, and wherein.

DETAILED DESCRIPTION OF THE PREFERRED EMBODIMENTS

Figure 1:
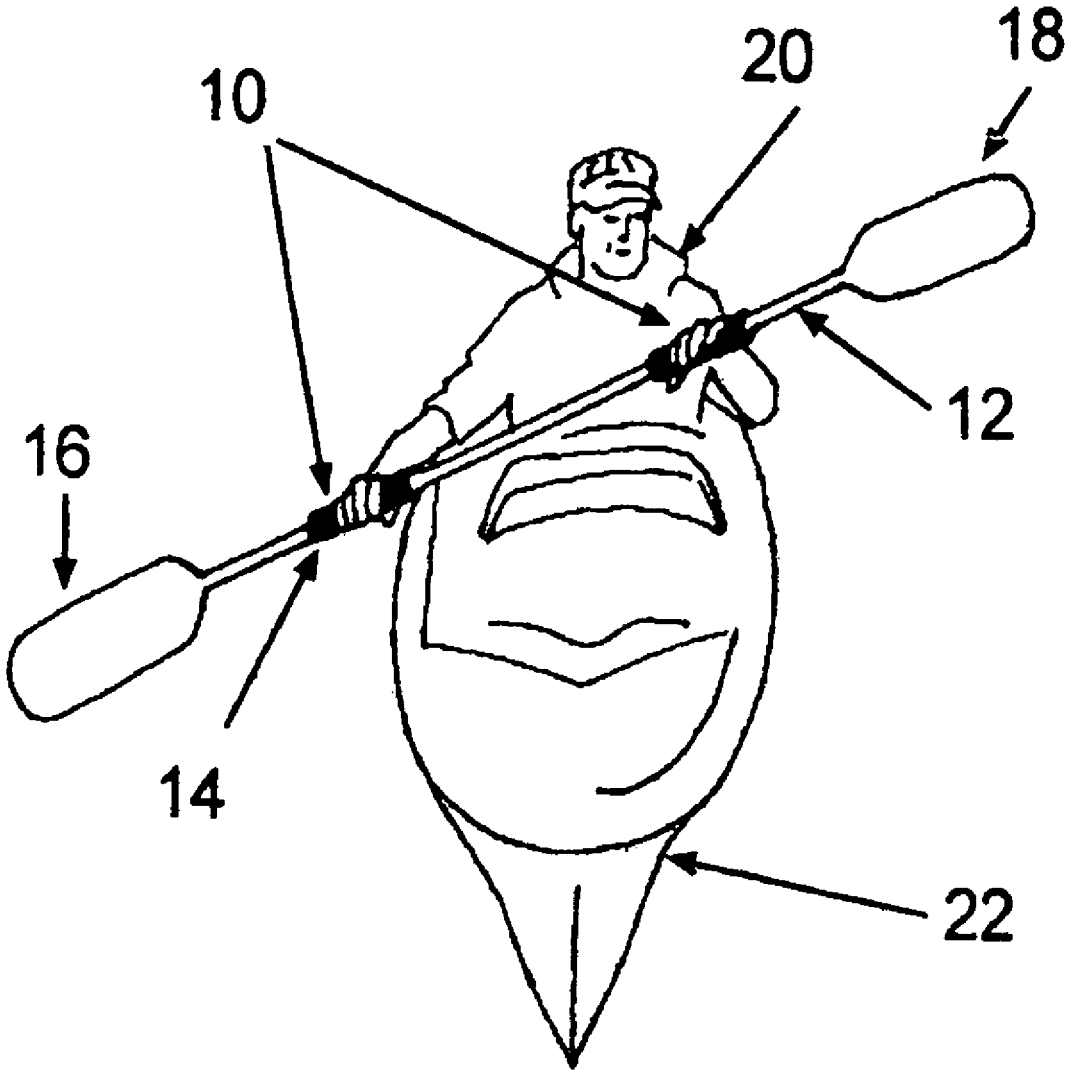
FIG. 1 is a perspective view showing two articles of manufacture in accordance with the invention in place, for use, on a paddle.

Referring to FIG. 1, there is shown a perspective view of comfort hand grips 10 (hereinafter also referred to as a grip or grips 10) incorporating features of the present invention, in place on the shaft 12 of an oar 14 having paddle blades 16 and 18 at respective ends thereof. The oar is used by a person 20 who is rowing, for example, a small boat 22, such as a kayak.

Although the present invention will be described with reference to the embodiments shown in the drawings, it should be understood that the present invention can be embodied in many alternate forms of embodiments. In addition, any suitable size, shape or type of elements or materials could be used. In addition, although the comfort grips of the present invention are shown on the shaft of an oar or paddle, it will be understood that they may be used on shafts of many kinds, including for example, the shaft of a baseball bat, or any other shaft that may cause discomfort when gripped.

Figure 2A:
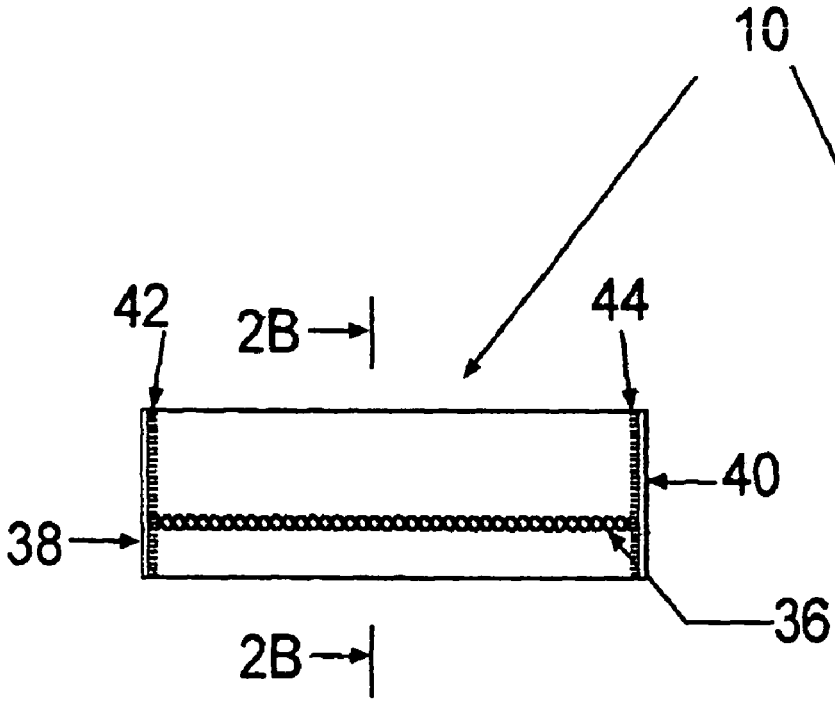
FIG. 2A is a plan view of a first embodiment of the invention.
Figure 2B:
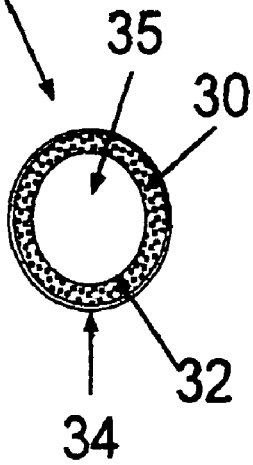
FIG. 2B is a cross sectional view of the embodiment of FIG. 2A taken along line 2B-2B thereof.

Referring to FIGS. 2A and 2B, the comfort hand grips 10 in accordance with the invention are formed by providing a generally rectangular piece of preferably die cut material having a core layer 30, formed of a closed cell elastic material, such as a neoprene rubber. A manufactured ingrained textured layer or surface 32 and a nylon outer layer 34 may be fused to the inner and outer surfaces, respectively, of the core layer 30 before die cutting. The nylon is water impervious and may be resistant to ultraviolet radiation, thus preventing the accumulation of water by the core layer 30 and protecting the core layer 30 from degradation when used in an outdoor environment. The material may have a thickness of approximately 5 millimeters.

The rectangular piece may be formed into a tubular structure, having an elongate shaft receiving opening 35, by connecting two opposite sides together by, for example, a stitching 36. End bands 38 and 40, consisting of generally rectangular pieces of an elastic or stretchable material are each disposed to have a portion disposed on the outside surface of grip 10 (on outer layer 34), and a similarly shaped portion disposed on the inside surface (on inner layer 32) of hand grip 10. Respective stitchings 42 and 44 secure end bands 38 and 40 in place at opposite ends of grip 10, thus covering the die cut ends thereof and assuring a neat appearance.

It is noted that for simplicity and ease of illustration, stitching, and other connection means, are generally not shown in the cross-sectional views herein.

Grips 10 may be 4 inches to 8 inches in length, but are preferably 6 inches in length. Opening 35 is large enough to receive a shaft when the material of grip 10 is stretched by the insertion of the shaft therein. Typically opening 35 will have a diameter of approximately 0.875 inches when not stretched, so as to accommodate a shaft of approximately 1.0 inch diameter when grip 10 is stretched around the shaft.

This first embodiment of the invention illustrated in FIG. 2A and FIG. 2B has particular application to the case where the paddle or oar of FIG. 1 may be disassembled at a central portion along its shaft 12. In the disassembled configuration, water may be applied to the shaft and to the inner surface of the grip 10. The grip may then be forced to slide down the shaft to a desired position.

Figure 3A:
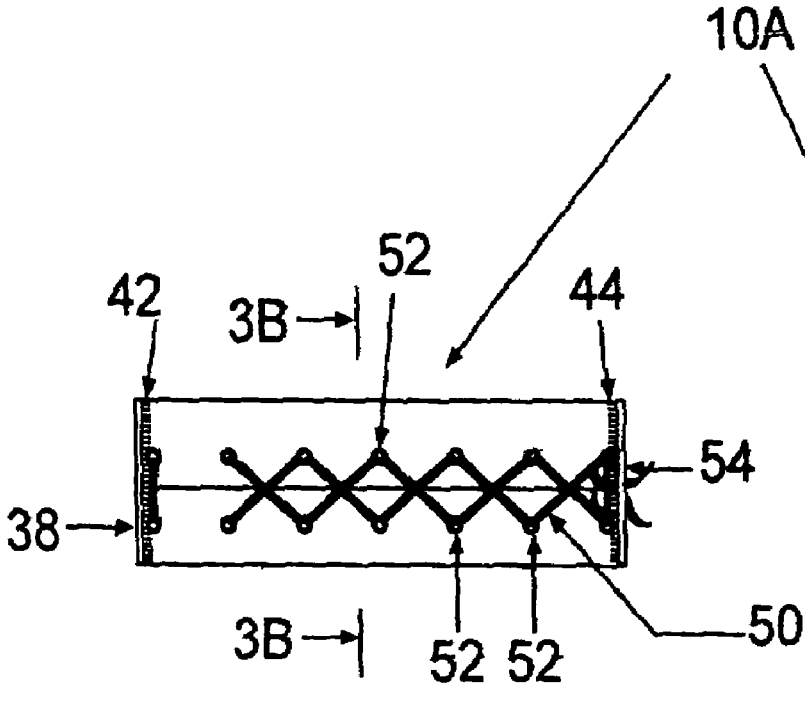
FIG. 3A is a plan view of a second embodiment of the invention.
Figure 3B:
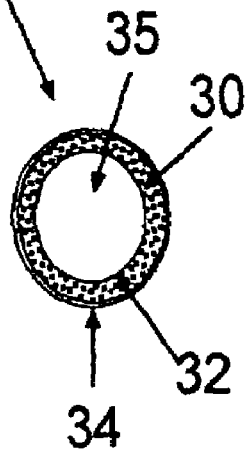
FIG. 3B is a cross sectional view of the embodiment of FIG. 3A taken along line 3B-3B thereof.

Referring to FIG. 3A and FIG. 3B, in this second embodiment of the invention, the tubular structure of the grip 10A is established by the use of a lace 50, threaded through a series of die cut holes 52. This structure is similar to that of the first embodiment, and will thus not be described in detail. However, the use of a lace permits grip 10A to be assembled on to the shaft of an oar or paddle that does not come apart, so that there is no difficulty with respect to the size of the blades preventing insertion of the shaft. The rectangular piece of material from which grip 10A is formed, is simply wrapped around the shaft, and then the lace is threaded and tied into a knot or bow 54.

Figure 4A:
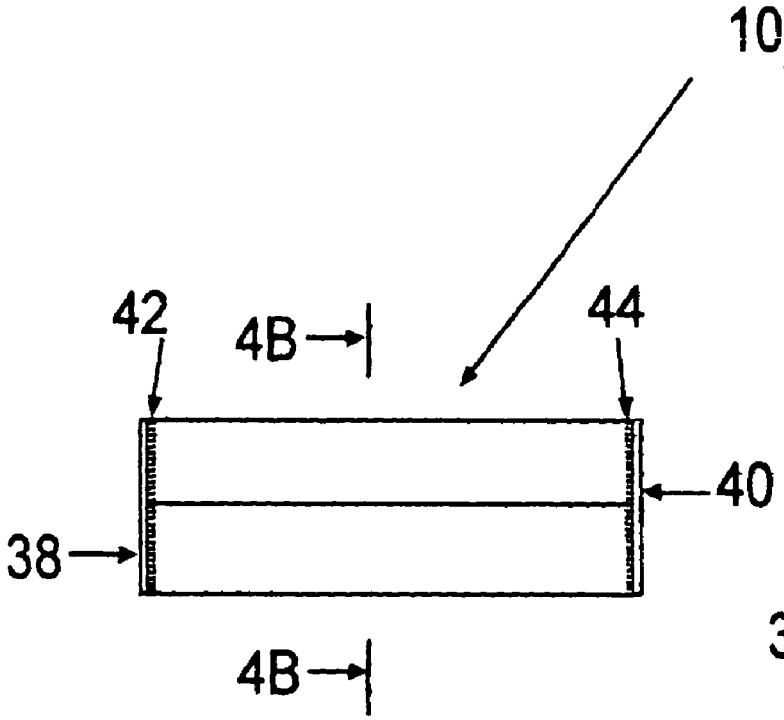
FIG. 4A is a plan view of a third embodiment of the invention.
Figure 4B:
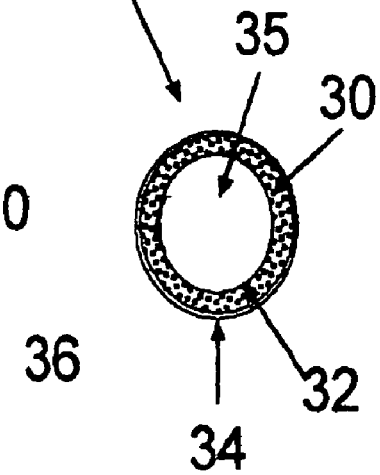
FIG. 4B is a cross sectional view of the embodiment of FIG. 4A taken along line 4B-4B thereof.

Referring to FIG. 4A and FIG. 4B, in a third embodiment of the invention, the tubular structure of grip 10B is formed by using hook and loop fasteners, of a type well known in the art. This embodiment may be used with oars or paddles which have shafts that disassemble and shafts that do not disassemble. The material is stretched to allow the hook and loop fasteners to be closed. There is an overlap of the sides which are connected to form the tubular structure as shown in FIG. 4A.

Figures 5A, 5B:
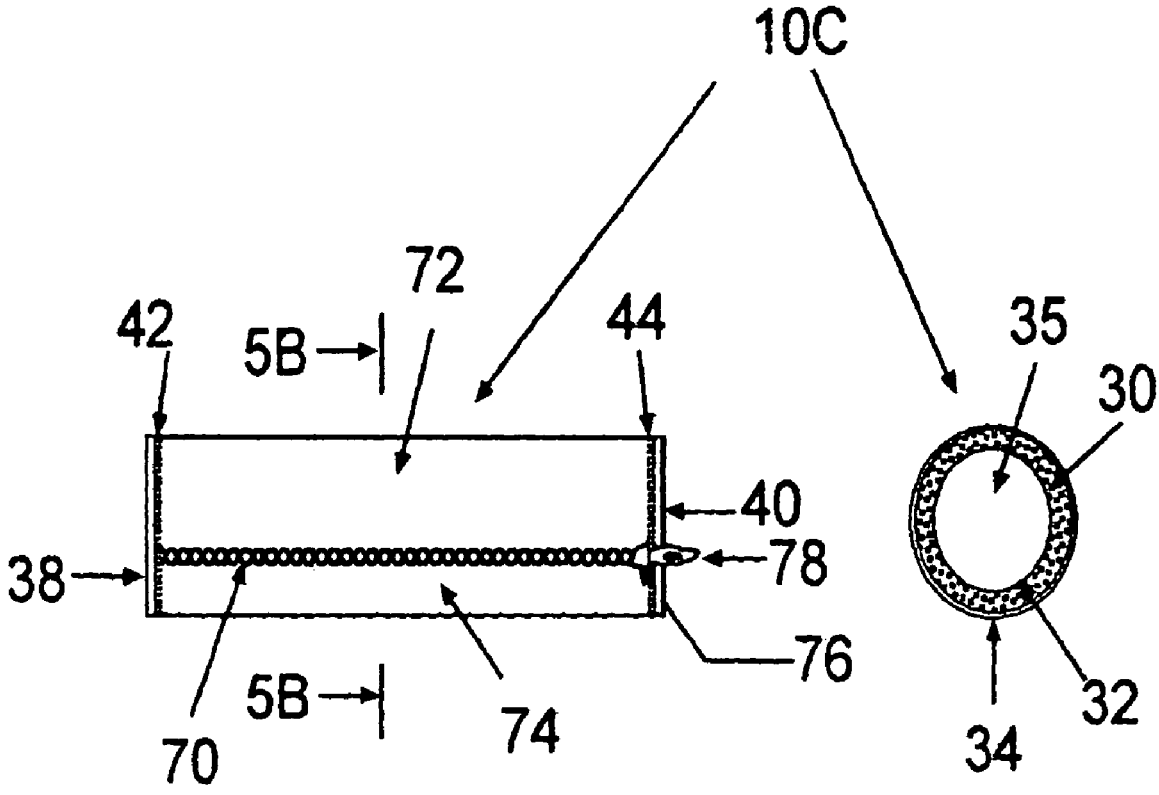
FIG. 5A is a plan view of a fourth embodiment of the invention.
FIG. 5B is a cross sectional view of the embodiment of FIG. 5A taken along line 5B-5B thereof.

Referring to FIG. 5A and FIG. 5B, in another embodiment of the invention, a zipper 70, having a first side 72 attached to a first connecting portion and a second side 74 attached to a second connecting portion of the material of grip 10C, has a zipper closure 76, with a zipper pull 78 extending therefrom. This embodiment may be used with oars or paddles which have shafts that disassemble and shafts that do not disassemble. The material is stretched when the zipper is closed.

Figure 6A:
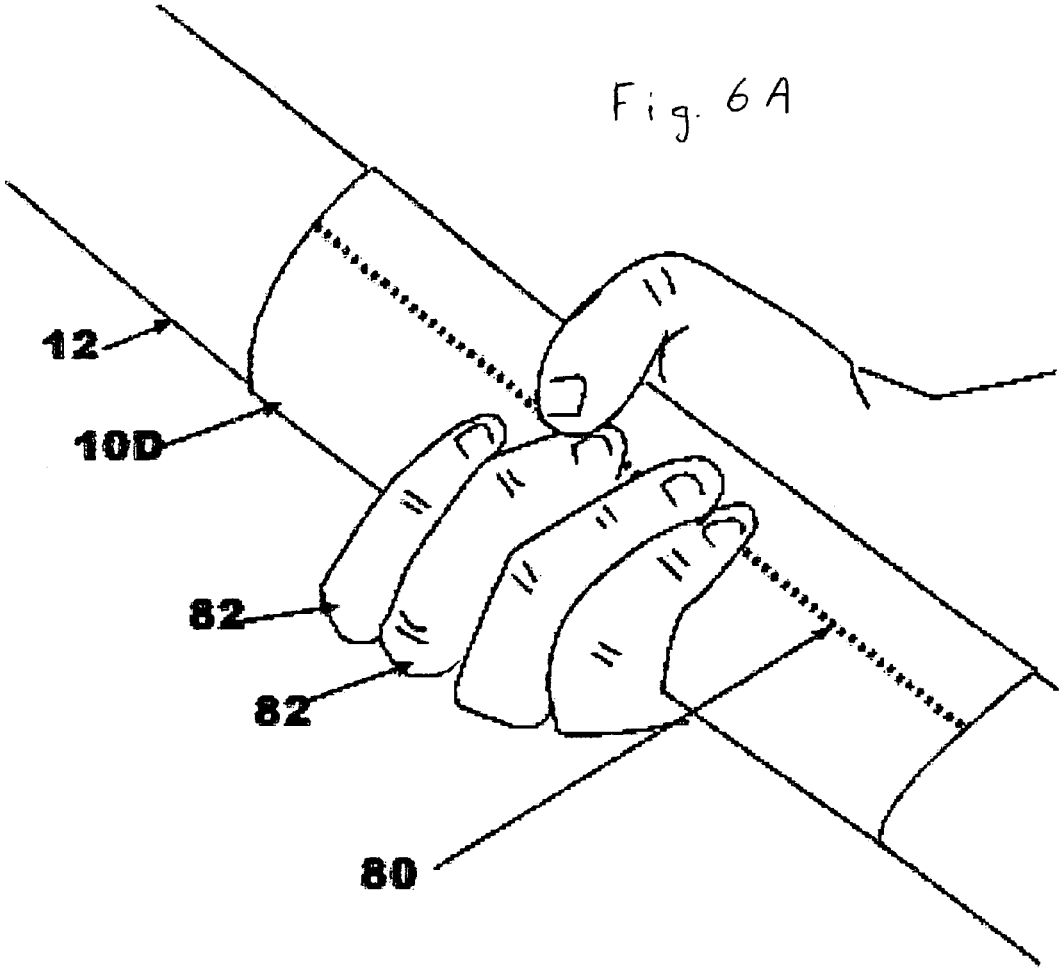
FIG. 6A is a perspective view of another embodiment of the invention.
Figure 6B:
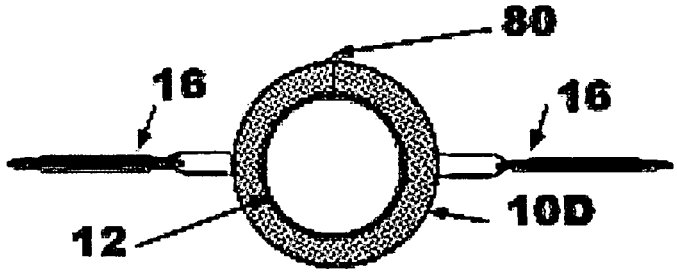
FIG. 6B is a cross-sectional view of the embodiment of FIG. 6A.

Referring to FIG. 6A and FIG. 6B, in another embodiment of the invention, a round shaft 12 of an oar has a grip 10D with a raised indexing marks 80 along a longitudinally extending line. Indexing line or marks 80 may be any of a continuous raised ridge, a series of bumps, or even a series of depressions in the outer surface of the material from which hand grips 10D are formed. The grips 10D are installed so the tips of the fingers 82 of a hand are resting on the raised indexing line or marks 80, and the knuckles are in line with the paddle blade. In other words, the indexing marks 80 are at a position that can be adjusted to each individual to align the knuckles of the hands with respect to the blades of the paddle (for example blade 16), as shown in FIG. 6B. This will keep the paddle blade angle perpendicular to the water surface to provide paddle indexing on any paddle, including round shaft paddles for which this feature was not previously available and for either right or left handed people. This will also enable proper technique for feathering the paddle and to perform Eskimo rolls properly.

Figure 7:
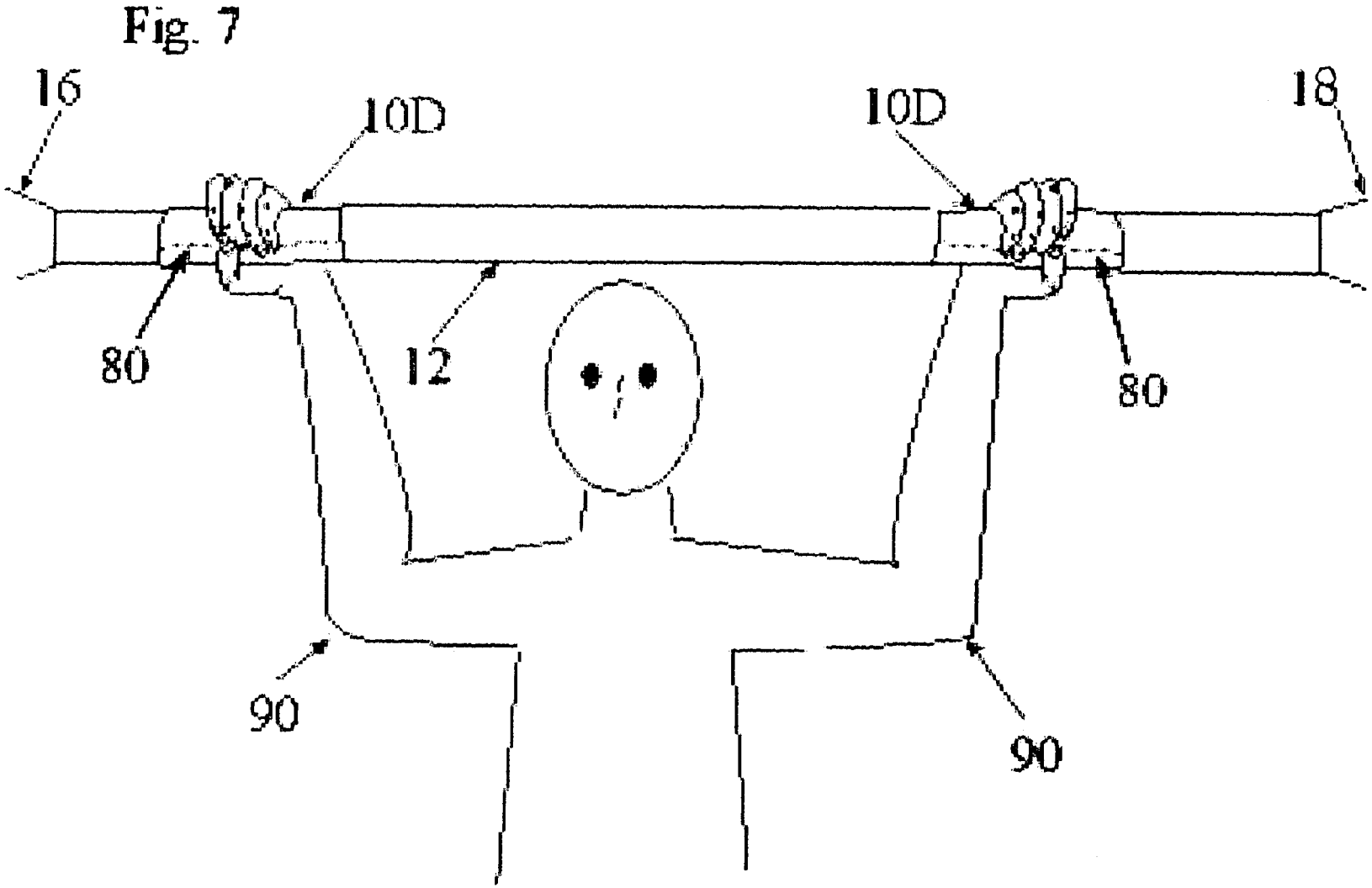
FIG. 7 is an illustration of the manner of use of the embodiment of FIG. 6A and FIG. 6B.

Referring to FIG. 7, the manner of placing and using the paddle grips 10D to maintain the correct hand positions on the shaft 12 of the paddle is illustrated. When the hands are placed on the paddle grips 10D in this manner, they will not slide out of position especially when the paddle shaft gets wet. The paddler should hold the paddle horizontally at the level of the top of the paddler's head, with elbows 90 bent at a ninety degree angle. The blades 16 and 18 of the paddle are in an orientation with the flat surfaces perpendicular to the ground. When the paddle grips are installed in this position (and gripped so that the indexing marks 80 are aligned on a side of the shaft, approximately diametrically opposite the knuckles) proper hand placement is assured.

The embodiments of the invention described above, other than that described with respect to FIG. 6A, FIG. 6B and FIG. 7, may also be used to accomplish indexing. The closure structures in these other embodiments may also provide the proper tactile sensations to a user to permit proper orientation of the shaft of an oar with respect to the hands, when the hand grip in accordance with the invention is placed on a shaft, and especially when the closure structures, which serve as indexing marks, are proper positioned with respect to the orientation of the paddle blades.

It is noted that more than one of the connecting means that are illustrated in the various embodiments may be used together. For example, hook and loop fasteners may be used in combination with a lace or with a zipper. Thus, at least one, but in the general case, more than one may be used in a single embodiment of a hand grip in accordance with the invention. If an adhesive or staples are used, there will be some overlap of the joining portions of the material that makes up the hand grip.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An apparatus comprising:

a comfort grip disposed around a portion of a shaft of a previously existing paddle having paddle blades for use in paddling in water, said shaft being of circular cross section along the entire length thereof, the comfort grip comprising:

a tubular member formed of a closed cell resilient polymer material core, said tubular member having a longitudinally extending indexing mark along an external surface of said tubular member, said indexing mark being configured to be sensed by fingertips when said shaft is gripped by a hand of a user, the indexing mark being adjustably oriented with respect to said shaft so as to facilitate alignment of knuckles of the hand with the paddle blade, so that the paddle blade is positioned as desired with respect to a water surface when paddling; and a water resistant coating on a first side of said core.

2. The apparatus of claim 1, wherein the comport grip further comprises a manufactured ingrained texture on a second side of said core.

3. The apparatus of claim 1, wherein the comport grip is sized so as to be slightly stretched when positioned on a shaft.

4. The apparatus of claim 1, wherein the resilient polymer core is formed of a rubber.

5. The apparatus of claim 1, wherein the coating is formed of a nylon.

6. The apparatus of claim 1, wherein the coating is formed of an ultraviolet resistant flexible material.

7. The apparatus of claim 1, wherein the comport grip is initially in the form of a rectangular piece of material, comprising joining portions along two opposite sides of the rectangular piece, said joining portions being connected to form the tubular member.

8. The apparatus of claim 7, further comprising connecting means for connecting said joining portions, said connecting portions comprising at least one of:

stitching along edges of said sides to connect said joining portions;

a lace disposed in openings in said joining portions;

a zipper having a side along each of said joining portions;

a set of hooks and loop closures on opposite ones of maid joining portions;

an adhesive along said joining portions; and a series of staples along said joining portions.

9. The apparatus of claim 1, further comprising end bands disposed only at ends of said tubular members.

10. The apparatus of claim 9, wherein said end bands comprise a stretchable material folded so as to have a first portion along an inner periphery of said tubular member and a second portion along an outer periphery of said tubular member.

11. The apparatus of claim 1, further comprising a second comfort grip on said shaft, said second comfort grip being positioned on said shaft at a position remote from said first comfort grip, so that each hand of a user may grip one of maid comfort grips during paddling, said second comfort grip being identical in construction and orientation to said first comfort grip.

12. The apparatus of claim 1, wherein said indexing mark is selected from the group consisting of a ridge, a line of bumps and a line of depressions.

13. The apparatus of claim 1, wherein said indexing mark is oriented with respect to said shaft so an to allow feathering strokes during paddling.

14. A method for forming a comfort grip for a shaft of a previously existing paddle having paddle blades for use in paddling in water, said shaft being of circular cross section along the entire length thereof, comprising:

providing a rectangular piece of stretchable material; and connecting two opposite sides of said rectangular piece of material to form a tubular member around said shaft, said tubular member being sized so as to stretch around said shaft when a portion of said shaft is disposed within said tubular member, said tubular member having a longitudinally extending indexing mark along an external surface of said tubular member, said indexing mark being configured to be sensed by fingertips when said shaft is gripped by a hand of a user, the indexing mark being adjustably oriented with respect to said shaft so as to facilitate alignment of knuckles of the hand with respect to the paddle blade, so that the paddle blade is positioned as desired with respect to a water surface when paddling.

15. The method of claim 14, wherein said connecting is done by providing at least one of:

a. stitches for joining said opposite sides to one another;

b. a lace through openings in portions of said material along said sides;

c. a zipper having a side along each of said joining portions; and d. a set of hooks and loop closures on opposite ones of said joining portions.

16. The method of claim 14, further comprising providing end bands formed of a stretchable material disposed only along ends of said tabular member.

17. The method of claim 16, wherein providing said end bands comprises:

positioning said bands with a first portion along an inner periphery of said tubular member and a second portion along an outer periphery of said tubular member; and fastening said end bands in place.

18. The method of claim 17, wherein said end bands are positioned by sewing the end bands to said tubular member.

19. A method for placing a comfort grip on a shaft of a previously existing paddle, said shaft being of circular cross section along the entire length thereof, comprising:

providing a comfort grip including a tubular member formed of a closed cell resilient polymer material core, said tubular member having a longitudinally extending indexing mark along an external surface of said tubular member, said indexing mark being configured to be sensed when said shaft is gripped to allow proper orientation of said shaft by a user; said tubular member further having a water resistant coating on each side of said core; and securing and adjusting said comfort grip on said shaft so that said indexing mark is aligned at a rotational position that is adjusted to an individual user to align the knuckles of the hand in line with a blade of said paddle.

20. The method of claim 19, wherein said securing is performed by at least one of:

a. sliding said comfort grip onto said shaft;

b. lacing said comfort grip to said shaft with a lace extending through opening in said tubular member;

c. closing a zipper, said zipper having a side along each of said joining portions; and d. closing a set of hook and loop closures on opposite ones of said joining portions.

* * * * *